US006525272B2

(12) United States Patent
Higashiura et al.

(10) Patent No.: US 6,525,272 B2
(45) Date of Patent: Feb. 25, 2003

(54) MULTILAYER INSULATED WIRE AND TRANSFORMER USING THE SAME

(75) Inventors: Atsushi Higashiura, Tokyo (JP); Isamu Kobayashi, Toyko (JP); Atsushi Taba, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 09/768,534

(22) Filed: Jan. 24, 2001

(65) Prior Publication Data

US 2001/0010269 A1 Aug. 2, 2001

(30) Foreign Application Priority Data

Jan. 25, 2000 (JP) ..... 2000-016270

(51) Int. Cl.[7] ..... H01B 7/00

(52) U.S. Cl. ..... 174/120 R

(58) Field of Search ..... 174/120 R, 120 SR, 174/110 SR, 110 N

(56) References Cited

U.S. PATENT DOCUMENTS

| | | | | |
|---|---|---|---|---|
| 5,606,152 A | * | 2/1997 | Higashiura et al. | 174/120 R |
| 5,644,105 A | * | 7/1997 | Castellani | 174/110 SR |
| 5,861,578 A | * | 1/1999 | Hake et al. | 174/120 R |
| 6,087,591 A | * | 7/2000 | Nguyen et al. | 174/120 R X |

FOREIGN PATENT DOCUMENTS

| | | | |
|---|---|---|---|
| EP | 0671746 A1 | * | 9/1995 |
| JP | 3-56112 | | 5/1991 |
| JP | 04-094012 | * | 3/1992 |
| JP | 06-223634 | | 8/1994 |
| JP | 11-283853 | * | 10/1999 |

* cited by examiner

*Primary Examiner*—Chau N. Nguyen
(74) *Attorney, Agent, or Firm*—Knobbe Martens Olson & Bear LLP

(57) ABSTRACT

A multilayer insulated wire which includes a conductor and two or more solderable, extruded insulating layers with which the conductor is coated. The first insulating layer nearest to the conductor includes a thermoplastic polyester elastomer resin and the outermost insulating layer is composed of a thermoplastic polyamide resin. A transformer in which the multilayer insulated wire is utilized.

12 Claims, 2 Drawing Sheets

MULTILAYER INSULATED WIRE AND TRANSFORMER USING THE SAME

FIELD OF THE INVENTION

The present invention relates to a multilayer insulated wire whose insulating layers are composed of two or more extrusion-coating layers. The present invention also relates to a transformer in which said multilayer insulated wire is utilized. More specifically, the present invention relates to a multilayer insulated wire that is useful as a lead wire and a winding of a transformer incorporated, for example, in electrical/electronic equipment; said wire has good solderability at a low temperature and a short period of time, at which an adverse effect is not easily produced on other members at the time of processing into a coil, and said wire is excellent in heat resistance, high-frequency characteristic, winding processing resistance, and solvent resistance. The present invention also relates to a transformer that utilizes said multilayer insulated wire.

BACKGROUND OF THE INVENTION

The construction of a transformer is prescribed by IEC (International Electrotechnical Communication) Standards Pub. 60950, etc. That is, these standards provide that at least three insulating layers be formed between primary and secondary windings in a winding, in which an enamel film which covers a conductor of a winding be not authorized as an insulating layer, or that the thickness of an insulating layer be 0.4 mm or more. The standards also provide that the creeping distance between the primary and secondary windings, which varies depending on the applied voltage, be 5 mm or more, that the transformer withstand a voltage of 3,000 V applied between the primary and secondary sides for a minute or more, and the like.

According to such the standards, as a currently prevailing transformer has a structure such as the one illustrated in a cross-section of FIG. 2. In the structure, an enameled primary winding 4 is wound around a bobbin 2 on a ferrite core 1 in a manner such that insulating barriers 3 for securing the creeping distance are arranged individually on the opposite sides of the peripheral surface of the bobbin. An insulating tape 5 is wound for at least three turns on the primary winding 4, additional insulating barriers 3 for securing the creeping distance are arranged on the insulating tape, and an enameled secondary winding 6 is then wound around the insulating tape.

In recent years, however, a transformer having a structure that neither includes an insulating barrier 3 nor an insulating tape layer 5, as shown in FIG. 1, has begun to penetrate rapidly into the market, instead of the transformer having the sectional structure shown in FIG. 2. The transformer shown in FIG. 1 has an advantage over the one having the structure shown in FIG. 2 in being able to be reduced in overall size and dispense with the winding operation for the insulating tape.

In manufacturing the transformer shown in FIG. 1, it is necessary, in consideration of the aforesaid IEC standards, that at least three insulating layers 4*b* (6*b*), 4*c* (6*c*), and 4*d* (6*d*) are formed on the outer peripheral surface on one or both of conductors 4*a* (6*a*) of the primary winding 4 and the secondary winding 6 used.

As such a winding, a winding in which an insulating tape is first wound around a conductor to form a first insulating layer thereon, and is further wound to form second and third insulating layers in succession, so as to form three insulating layers that are separable from one another, is known. Further, a winding in which a conductor enameled with polyurethane is successively extrusion-coated with a fluororesin, whereby extrusion-coating layers composed of three layers structure in all are formed for use as insulating layers, is known (JU-A-3-56112 ("JU-A" means unexamined published Japanese utility model application)).

In the above-mentioned case of winding an insulating tape, however, because winding the tape is an unavoidable operation, the efficiency of production is extremely low, and thus the cost of the electrical wire is conspicuously increased.

In the above-mentioned case of extrusion of a fluororesin, since the insulating layer is made of the fluororesin, there is the advantage of good heat resistance and high-frequency characteristic. On the other hand, because of the high cost of the resin and the property that when it is pulled at a high shearing speed, the external appearance is deteriorated, it is difficult to increase the production speed, and like the insulating tape, the cost of the electric wire becomes high. Further, in this case of the insulating layer, there is a problem that, since the insulating layer cannot be removed by dipping in a solder bath, the insulating layer on the terminal has to be removed using less reliable mechanical means, and further the wire must be soldered or solderless-connected, when the terminal is worked for the insulated wire to be connected, for example, to a terminal.

On the other hand, a multilayer insulated wire is put to practical use, wherein multilayer extrusion-insulating layers are formed from a mixture of a polyethylene terephthalate as a base resin with an ionomer prepared by converting part of carboxyl groups of an ethylene/methacrylic acid copolymer to metal salts, and wherein the uppermost covering layer among the insulating layers is made of an aliphatic polyamide (nylon). This multilayer insulated wire is excellent in cost of electrical wire (nonexpensive materials and high producibility), solderability (to make possible direct connection between an insulated wire and a terminal), and coilability (that means that, in winding the insulated wire around a bobbin, the insulating layer is not broken to damage the electrical properties of the coil, when, for example, parts of the insulated wire are rubbed with each other or the insulated wire is rubbed with a guide nozzle) (JP-A-6-223634 ("JP-A" means unexamined published Japanese patent application)).

Recently, however, as a bobbin used in these transformers, a resin material having a low heat resistance has started to be used, from the viewpoint of recycling. When a conventional multilayer insulated wire is used in such a transformer, there may arise a problem that an adverse effect is produced on other members at the temperature and time necessary for processing into a coil. Thus, needs for a multilayer insulated wire having solderability at a low temperature and a short time, have been increasing.

SUMMARY OF THE INVENTION

The present invention is a multilayer insulated wire, which comprises a conductor and two or more solderable, extruded insulating layers with which the conductor is coated, wherein the first insulating layer nearest to the conductor is composed of a thermoplastic polyester elastomer resin and the outermost insulating layer is composed of a thermoplastic polyamide resin.

Further, the present invention is a transformer, wherein the above multilayer insulated wire is utilized.

DETAILED DESCRIPTION

Figure 1:
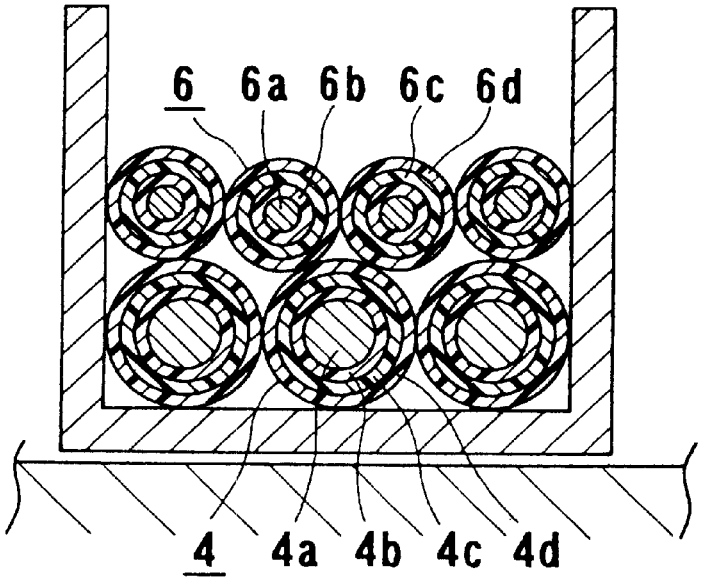
FIG. 1 is a cross-sectional view illustrating an example of the transformer having a structure in which three-layer insulated wires are used as windings.

The present inventors, after eagerly investigating in view of the above-mentioned problems, have found that, in a multilayer insulated wire comprising a conductor and two or more solderable, extruded insulating layers with which the conductor is coated, by using a thermoplastic polyester elastomer resin in the first insulating layer nearest to the conductor, and using a thermoplastic polyamide resin in the outermost insulating layer, the obtained multilayer insulated wire can be caused to have solderability at a low temperature and a short time and have excellent winding processing resistance and solvent resistance; and, a transformer that can be produced at a relatively low temperature and short time can be obtained using this wire.

The present invention is accomplished based on this finding.

That is, according to the present invention there is provided:

(1) A multilayer insulated wire comprising a conductor and two or more solderable, extruded insulating layers with which the conductor is coated, wherein the first insulating layer nearest to the conductor is composed of a thermoplastic polyester elastomer resin and the outermost insulating layer is composed of a thermoplastic polyamide resin;

(2) The multilayer insulated wire according to the item (1), wherein the thermoplastic polyester elastomer is a polybutylene terephthalate elastomer;

(3) The multilayer insulated wire according to the item (1) or (2), wherein the amount of hard segments of the thermoplastic polyester elastomer is 40% by weight or more; and (4) A transformer, wherein the multilayer insulated wire as stated in any one of the items (1) to (3) is utilized.

According to the present invention, in a multilayer insulated wire comprising a conductor and two or more solderable, extruded insulating layers with which the conductor is coated, a thermoplastic polyester elastomer resin is used in the first insulating layer nearest to the conductor and a thermoplastic polyamide resin is used for the outermost insulating layer. In this way, soldering can be carried out at a low temperature and a short time, and further heat resistance (Class A) can be kept at a level causing no problem in practical use.

As the thermoplastic polyester elastomer resin, the following (A) and (B) can be mentioned.

(A) A thermoplastic polyester elastomer resin wherein its hard component (segment) is an aromatic polyester and its soft component (segment) is an aliphatic polyether, an aromatic polyether or an aliphatic polyester. The aromatic polyester may be polybutylene terephthalate or polyethylene terephthalate. The aliphatic polyether may be polytetramethylene ether glycol, and the aromatic polyether may be polytetramethylene ether terephthalate. The aliphatic polyester may be polylactone. However, the present invention is not limited to these examples.

(B) A thermoplastic polyester elastomer resin wherein its hard component is an aromatic polyester whose acid component is mainly composed of an aromatic dicarboxylic acid (which means that the amount of said acid is preferably 70 mol % or more in said acid component, which is applied similarly hereafter) and whose glycol component is mainly composed of an aliphatic α, ω-diol having 2 to 4 carbon atoms and/or 1,4-cyclohexanedimethanol (which means that the amount of said diol is preferably 70 mol % or more in said glycol component, which is applied similarly hereafter), and wherein its soft component is a polyester whose acid component is mainly composed of an aromatic dicarboxylic acid having a bent structure, such as isophthalic acid and/or phthalic acid, and whose glycol component is mainly composed of an aliphatic α,ω-diol having 6 to 12 carbon atoms.

Considering heat resistance (thermal deterioration and softening temperature), the thermoplastic polyester elastomer resin (B) is preferred. Furthermore, the thermoplastic polyester elastomer resin wherein the ratio of the hard component is 40% by weight or more is preferred.

Specific examples include polyethylene terephthalate-series elastomer resins (PET elastomers), and polybutylene terephthalate-series elastomer resins (PBT elastomers). As the PBT elastomer resin, commercially available Pelprene (trade name, manufactured by Toyobo Co., Ltd.), Nubelan (trade name, manufactured by Teijin Ltd.) and the like, can be used.

As the polyester-series elastomer resin that can be used herein, modified polyester having a melting point of 200° C. or higher is preferred and modified polyester having a melting point of 220° C. or higher is particularly preferred, particularly from the viewpoint of heat softening property and heat resistance. In this case, it is possible to suppress remarkably generation of cracks and a decrease in electric property due to progress of crystallization, which are observed in polyester resins not converted to elastomers.

Further, wires utilizing a thermoplastic polyester elastomer resin having a bending modulus of elasticity of 100 MPa or less are easy to be crushed, though the resultant wires have no problems about standards and properties. Therefore, it is necessary to pay attention to high tension winding thereof into a coil.

As the thermoplastic polyamide resin, a resin produced from raw materials, such as diamine and dicarboxylic acid, by any known process can be used. Commercially available examples of the resin include nylon 6,6 such as Amilan (trade name, manufacture by Toray Industries, Inc.), Zytel (trade name, manufactured by Du Pont Inc.) and Maranyl (trade name, manufactured by Unitika Ltd.); nylon 4,6 such as Unitika Nylon 46 (trade name manufactured by Unitika Ltd.); and nylon 6T/6,6 such as HT nylon (trade name, manufactured by Toray Industries, Inc).

In the above-mentioned polyamide, decomposition reaction based on thermal deterioration, and crosslinking reaction arise simultaneously, which is different from the polyester elastomer. Therefore, the polyamide has good film-remaining ability and exhibits a function as a protection layer so as to have a function for suppressing a decrease in heat resistance of the polyester elastomer as an inner layer. In the present invention, the above-mentioned polyamide resin forms the outermost layer in a multilayer insulated wire.

A known solid paraffin, a known wax (a fatty acid or a wax) or the like can be preferably used as a surface-treating agent for the multilayer insulated wire. The reason for this is as follows. Refrigerating machine oil used for enameled windings is poor in lubricity and is liable to generate shavings in processing into a coil. The problems such as generation of shavings can be remarkably solved by applying a solid paraffin, a wax or the like in a known manner.

As the conductor for use in the present invention, a metal bare wire (solid wire), an insulated wire having an enamel film or a thin insulating layer coated on a metal bare wire, a multicore stranded wire (a bunch of wires) composed of intertwined metal bare wires, or a multicore stranded wire composed of intertwined insulated-wires that each have an enamel film or a thin insulating layer coated, can be used. The number of the intertwined wires of the multicore stranded wire (a so-called litz wire) can be chosen arbitrarily depending on the desired high-frequency application. Alternatively, when the number of wires of a multicore wire is large, for example, in a 19- or 37-element wire, the multicore wire (elemental wire) may be in a form of a stranded wire or a non-stranded wire. In the non-stranded wire, for example, multiple conductors that each may be a bare wire or an insulated wire to form the elemental wire, may be merely gathered (collected) together to bundle up them in an approximately parallel direction, or the bundle of them may be intertwined in a very large pitch. In each case of these, the cross-section thereof is preferably a circle or an approximate circle. However, it is required that, as the material of the thin insulation, a resin that is itself good in solderability, such as a polyurethan resin, and an imide-modified polyurethane resin, be used, and specifically, for example, WD-438 (trade name, manufactured by Hitachi Chemical Co., Ltd.), and TPU-F1 (trade names, manufactured by Totoku Toryo Co.) can be used. Further, application of solder to the conductor or plating of the conductor with tin is a means of improving the solderability.

As a preferable embodiment of the present invention, mention can be made of the multilayer insulated wire made up of three layers, and preferably, the overall thickness of the three extrusion-coating insulating layers is controlled within the range of 60 to 180 $\mu$m. This is because the electrical properties of the resulting heat-resistant multilayer insulated wire are greatly lowered, to make the wire impractical, in some cases, if the overall thickness of the insulating layers is too thin. On the other hand, the solderability is deteriorated considerably in some cases, if the overall thickness of the insulating layers is too thick. More preferably the overall thickness of the extrusion-coating insulating layers is in the range of 70 to 150 $\mu$m. Preferably, the thickness of each of the above three layers is controlled within the range of 20 to 60 $\mu$m. In the present invention, when three or more extruded insulating layers are provided, there is no particular restriction on an intermediate layer(s) other than the first insulating layer nearest to a conductor and the outermost insulating layer. Preferably, the intermediate layer is a layer composed of a thermoplastic polyester elastomer resin similarly to the first insulating layer nearest to a conductor. When two or more layers composed of a thermoplastic polyester elastomer resin are provided, the kind of resins thereof may be the same or different from, but the same kind of resin is preferably used.

The transformer using the multilayer insulated wire of the present invention naturally satisfies the IEC60950 standards. Since no insulating tape is wound in the transformer, the transformer can be made small and has a good high-frequency characteristic. The terminal of the transformer can be soldered at a low temperature and a short time. Thus, the transformer can cope with high reliability and strict design.

Figure 2:
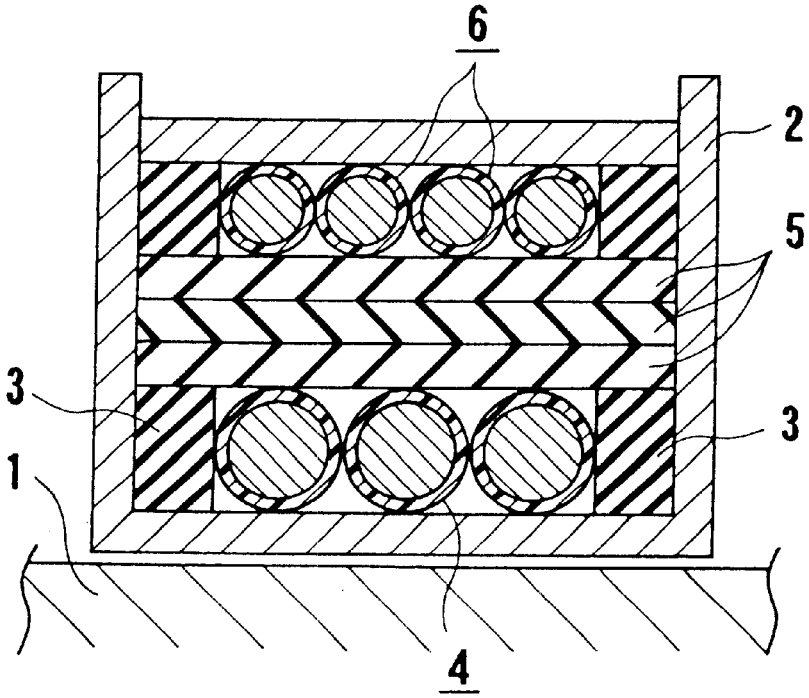
FIG. 2 is a cross-sectional view illustrating an example of the transformer having a conventional structure.

The multilayer insulated wire of the present invention can be used as a winding for any type of transformer, including those shown in FIG. 1 and FIG. 2. In such a transformer, generally a primary winding and a secondary winding are wound in a layered manner on a core, but the multilayer insulated wire of the present invention may be applied to a transformer in which a primary winding and a secondary winding are alternatively wound. In the transformer of the present invention, the above-mentioned multilayer insulated wire may be used for both of a primary winding and a secondary winding or for either thereof. In the case that the multilayer insulated wire of the present invention is composed of two layers (for example, in the case that each of the primary winding and the secondary winding is composed of a two-layer insulated wire, or in the case that an enameled wire is used for the one and a two-layer insulated wire is used for the other), at least one insulating barrier layer can be interposed between the two windings to use the multilayer insulated wire.

In the multilayer insulated wire of the present invention, the thermoplastic polyester elastomer resin is used in the first insulating layer nearest to the conductor and the thermoplastic polyamide resin is used in the outermost insulating layer, thereby the multilayer insulated wire of the invention can exhibit such excellent effects that the wire of the invention can be excellently soldered even at a low temperature and a short time as well as it satisfies the heat resistance Class A.

Even if a resin material having a low heat resistance is used for members, such as a bobbin, the transformer of the present invention using this multilayer insulated wire exhibits such excellent effect that the transformer can be produced at a low temperature and a short time without influencing an adverse effect on these members.

The present invention will now be described in more detail with reference to the following examples, but the present invention is not limited to those.

EXAMPLES

Examples 1 to 4 and Comparative Examples 1 to 4

As conductors, annealed copper wires having a wire diameter of 0.4 mm were prepared. A first layer, a second layer and a third layer, with the blended components (parts by weight) and thickness of resins for extrusion-coating for each layer, as shown in Table 1, were successively extruded and applied onto each of the conductors, to produce a multilayer insulated wire.

About the thus-obtained respective multilayer insulated layers, respective properties thereof were measured and evaluated by the following test methods. The resins that were used in the respective Examples and the respective Comparative examples, as shown in Table 1, are as follows.

Polyester Elastomer Resin

PBT Elastomer *1:

Nubelan P4128AN (trade name, manufactured by Teijin Ltd.), melting point: 222° C., and soft segment: about 60% by weight (bending modulus of elasticity: 170 MPa), PBT Elastomer *2:

Nubelan P4150AN (trade name, manufactured by Teijin Ltd.), melting point: 225° C., and soft segment: about 40% by weight (bending modulus of elasticity: 530 MPa), PBT Elastomer *3:

Nubelan P4110AN (trade name, manufactured by Teijin Ltd.), melting point: 210° C., and soft segment: about 70% by weight (bending modulus of elasticity: 35 MPa), (Polyamide Resin)

Nylon 6,6: Amilan CM3001N (trade name, manufactured by Toray Industries, Inc.),

Nylon 4,6: Nylon 4,6 F-5001 (trade name, manufactured by Unitika Co., Ltd.), (Other Resins)

PET: TR8550 (trade name, manufactured by Teijin Ltd.), polyester resin (polyethylene terephthalate), PBT: CN7000 (trade name, manufactured by Teijin Ltd.), polyester resin (polybutylene terephthalate), Ionomer: Highmilan 1855 (trade name, manufactured by Mitsui Polychemical Co., Ltd.), ethylene/methacrylic acid copolymer (ionomer), and FEP: Teflon FEP (trade name, manufactured by Du Pont Inc.), fluorine resin.

(3) Heat Resistance:

The heat resistance was evaluated by the following test method, in conformity to Annex U (Insulated wires) of Item 2.9.4.4 and Annex C (Transformers) of Item 1.5.3 of 60950-standards of the IEC standards. Conditions are under Class A (105° C.).

TABLE 1

| | | | Example 1 | Example 2 | Example 3 | Example 4 | Comparative example 1 | Comparative example 2 | Comparative example 3 | Comparative example 4 |
|---|---|---|---|---|---|---|---|---|---|---|
| First layer | Polyester elastomer | PBT elastomer *1 | 100 | | | 100 | | | 100 | |
| | | PBT elastomer *2 | | 100 | | | | | | |
| | | PBT elastomer *3 | | | 100 | | | | | |
| | Polyamide resin | Nylon6,6 | | | | | | | | |
| | | Nylon4,6 | | | | | | | | |
| | Other resins | PET | | | | | 100 | | | |
| | | PBT | | | | | | 100 | | |
| | | Ionomer | | | | | 15 | | | |
| | | FEP | | | | | | | | 100 |
| | Thickness of the resin (μm) | | 33 | 33 | 33 | 50 | 33 | 33 | 33 | 33 |
| Second layer | Polyester elastomer | PBT elastomer *1 | 100 | | | 100 | | | 100 | |
| | | PBT elastomer *2 | | 100 | | | | | | |
| | | PBT elastomer *3 | | | 100 | | | | | |
| | Polyamide resin | Nylon6,6 | | | | | | | | |
| | | Nylon4,6 | | | | | | | | |
| | Other resins | PET | | | | | 100 | | | |
| | | PBT | | | | | | 100 | | |
| | | Ionomer | | | | | 15 | | | |
| | | FEP | | | | | | | | 100 |
| | Thickness of the resin (μm) | | 33 | 33 | 33 | 50 | 33 | 33 | 33 | 33 |
| Third layer | Polyester elastomer | PBT elastomer *1 | | | | | | | 100 | |
| | | PBT elastomer *2 | | | | | | | | |
| | | PBT elastomer *3 | | | | | | | | |
| | Polyamide resin | Nylon6,6 | 100 | 100 | | 100 | 100 | | | |
| | | Nylon4,6 | | | 100 | | | | | |
| | Other resins | PET | | | | | | | | |
| | | PBT | | | | | | 100 | | |
| | | Ionomer | | | | | | | | |
| | | FEP | | | | | | | | 100 |
| | Thickness of the resin (μm) | | 34 | 34 | 34 | 50 | 34 | 34 | 34 | 34 |
| Whole thickness (μm) | | | 100 | 100 | 100 | 150 | 100 | 100 | 100 | 100 |
| Surface treatment | | | Fatty acid wax | Refrigerating machine oil | Solid paraffin | Solid paraffin | Fatty acid wax | Fatty acid wax | Fatty acid wax | Fatty acid wax |
| Conductor used | | | 0.4 ø Cu wire | 0.4 ø Cu wire | 0.4 ø Cu wire | 0.4 ø Cu wire | 0.4 ø Cu wire | 0.4 ø Cu wire | 0.4 ø Cu wire | 0.4 ø Cu wire |
| Properites | Solderability | 400° C. (sec) | 1 | 1 | 1> | 1.5 | 3 | 3 | 1 | 20 sec NG |
| | Breakout voltage | KV average | 22.1 | 24.5 | 22.5 | 30.5 | 23.5 | 22.5 | 23 | 23.2 |
| | Heat resistance | Class A | Passed | Passed | Passed | Passed | Passed | Not passed | Not passed | Passed |
| | High-frequency characteristic | 3.5 kV Average | 0.8 | 1 | 0.9 | 3.8 | 1.5 | 1.5 | 0.9 | 51.3 |
| | Static friction coefficient | Average | 0.08 | 0.11 | 0.07 | 0.07 | 0.09 | 0.09 | 0.09 | 0.06 |

Test Methods (1) Solderability:

A length of about 40 mm at the end of the insulted wire was dipped in molten solder at a temperature of 400° C., and the time (sec) required for the adhesion of the solder to the dipped 30-mm-long part was measured. The shorter the required time is, the more excellent the solderability is. The numerical value shown was the average value of n=3.

The difference between 3 seconds at 400° C. and 1.5 second at 400° C. has a large significance in this field. For reference, 1.5 second at 400° C. is equal to 3 seconds at 380 to 390° C., corresponding to a decrease by about 10 to 20° C. in soldering temperature.

(2) Insulation Breakdown Voltage:

The dielectric breakdown voltage was measured in accordance with the two-twisting method of JIS C $3003^{-1984}$ 11. (2).

Ten turns of the multilayer insulated wire were wound around a mandrel of diameter 6 mm under a load of 118 MPa (12 kg/mm$^2$). They were heated for 1 hour at 200° C., and then for additional 71 hours at 175° C., and then they were kept in an atmosphere of 25° C. and relative humidity 95% for 48 hours. Immediately thereafter, a voltage of 3,000 V was applied thereto, for 1 min. When there was no electrical short-circuit, it was considered that it passed Class A. (The judgment was made with n=5. It was considered that it did not pass the test if it was NG even when n=1.)

(4) High-Frequency V-t Characteristic:

A test specimen was made in accordance with the two-twisting method of JIS C $3003^{-1984}$ 11. (2), and the life (min) until the occurrence of short-circuit at an applied voltage of 3.5 kv, a frequency of 100 kHz, and a pulse duration of 10 μs was measured.

Figure 3:
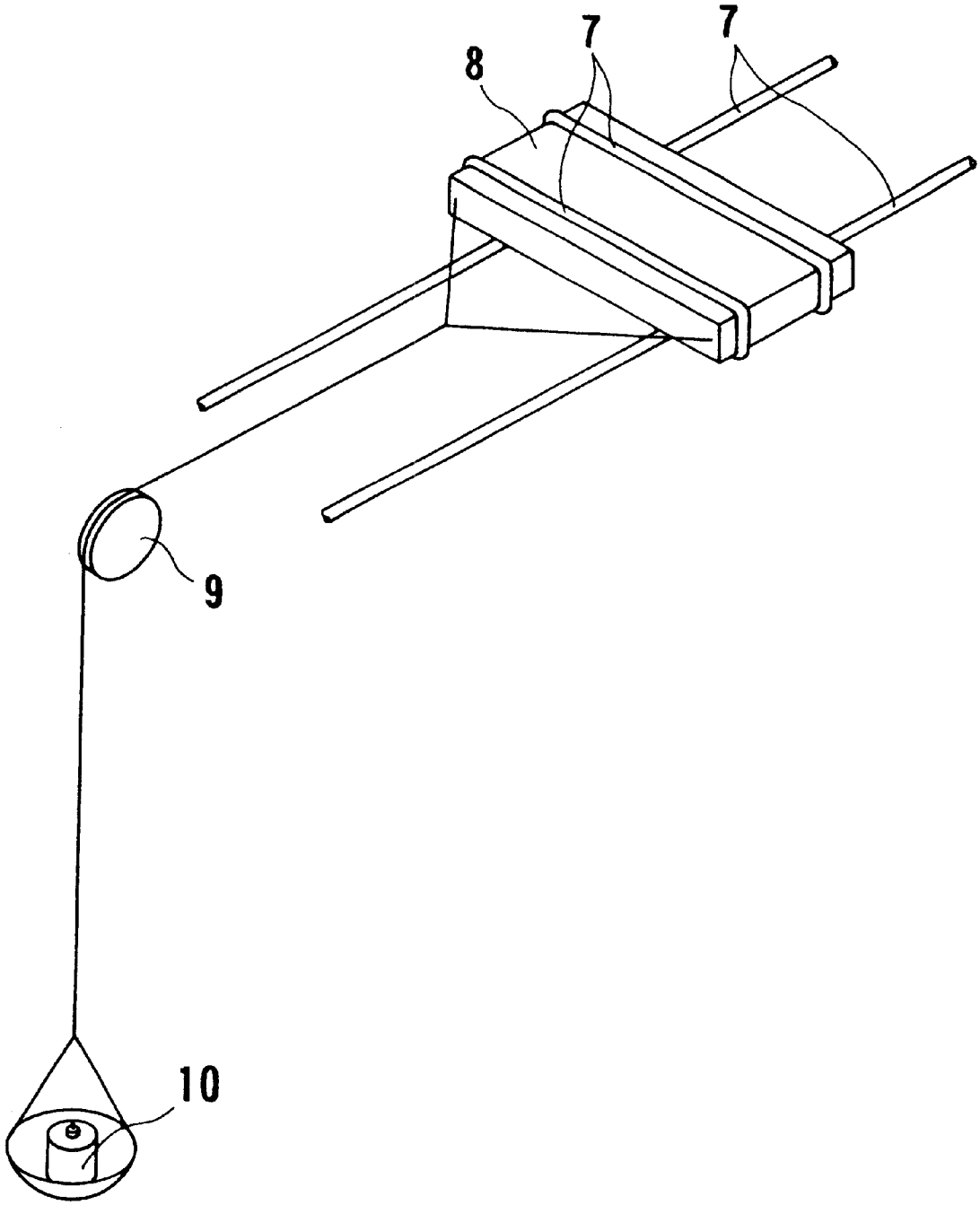
FIG. 3 is a schematic diagram showing a method of measuring static friction coefficients.

(5) Coilability (Static Friction Coefficients):

Static friction coefficient of the wire was measured with an apparatus shown in FIG. 3. In FIG. 3, 7 indicates multilayer insulated wires, 8 indicates a load plate and its mass is designated as W(g). 9 indicates a pulley, and 10 indicates a load. Letting the mass of the load 10 be F (g) when the load plate 8 whose mass is W (g) starts to move, the static friction coefficient is found from F/W.

The smaller the obtained numerical value is, the better the slipperiness of the surface is and the better the coilability (winding processing resistance) is.

The followings can be understood from the above-mentioned results.

In Examples 1 to 3, the PBT elastomer was used for the first and second layers, and nylon 6,6 or nylon 4,6 was used for the third layer so that the soldering time thereof was particularly short and the other properties were at good levels for practical use. In this connection, Example 3 had no problems with the standard for wires and properties; however, the deformation of the wire was relatively large in the case of tension-winding at 2 kgf/mm$^2$ or more, since PDT elastomer *3 that had low bending modulus of elasticity was utilized as a thermoplastic polyester elastomer resin.

In Example 4, the overall thickness was 150 $\mu$m, which was slightly large. Therefore, the soldering time thereof was slightly long, but the other properties were at good levels for practical use. The wire of Example 4 was used without any problem.

The multilayer insulated wires obtained in these Examples and comparative examples were excellent in solvent resistance., In Comparative example 1, nylon 6,6 was used for the third layer but the polyester resin not converted to any elastomer was used for the first layer. The soldering time thereof was conspicuously larger than that of each Example.

In Comparative example 2, the PBT not converted to any elastomer was used for all of the layers. Cracks due to crystallization were generated so that the wire of Comparative Example 2 did not pass heat resistance Class A and the solderability time became so conspicuously long as 3 seconds.

In Comparative example 3, the PBT elastomer was used for all of the layers so that the solderability was good but the wire of the Comparative Example 3 did not pass heat resistance Class A.

In Comparative example 4, the fluorine resin was used, so that soldering was unable to be performed.

Having described our invention as related to the present embodiments, it is our intention that the invention not be limited by any of the details of the description, unless otherwise specified, but rather be construed broadly within its spirit and scope as set out in the accompanying claims.

What we claim is:

1. A multilayer insulated wire comprising a conductor and two ore more solderable, extruded insulating layers with which the conductor is coated, wherein the first insulating layer nearest to the conductor comprises a thermoplastic polyester elastomer resin and the outermost insulating layer comprises a thermoplastic polyamide resin, wherein the thermoplastic polyester elastomer resin comprises hard and soft segments, wherein the amount of hard segment is 40% by weight or more; and wherein the thermoplastic polyester resin is selected from the group consisting of:

(A) a thermoplastic polyester elastomer resin wherein the hard segment comprises an aromatic polyester and the soft segment comprises either an aliphatic polyether, an aromatic polyether or an aliphatic polyester, and (B) a thermoplastic polyester elastomer resin, wherein the hard segment comprises an aromatic polyester whose acid component is mainly composed of an aromatic dicarboxlyic acid and whose glycol component is mainly composed of an aliphatic $\alpha,\omega$-diol having 2 to 4 carbon atoms, or 1,4- cyclohexanedimethanol, or a combination thereof and wherein the soft segment comprises a polyester having an acid composed mainly of an aromatic dicarboxlyic acid having a bent structure, and a glycol component composed mainly of an aliphatic $\alpha,\omega$-diol having 6 to 12 carbon atoms.

2. The multilayer insulated wire according to claim 1, wherein the aromatic polyester hard segment is selected from the group consisting of polybutylene terephthalate and polyetylene terephthalate.

3. The multilayer insulated wire according to claim 1, wherein the thermoplastic polyester elastomer resin has a melting point of 200° C. or higher.

4. The multilayer insulated wire according to claim 1, wherein said two or more solderable, extruded insulating layers comprise three solderable, extruded insulating layers, wherein the first insulating layer nearest to the conductor comprises said thermoplastic polyester elastomer resin, the second insulating layer on the first insulating layer comprises said thermoplatic polyester elastomer resin, and the outermost insulating layer comprises a thermoplastic polyamide resin.

5. A transformer, wherein the multilayer insulated wire as claimed in claim 1 is utilized.

6. The multilayer insulated wire according to claim 1, wherein the total thickness of the insulating layers is between about 60 and 180 $\mu$m.

7. The multilayer insulated wire according to claim 1, wherein said aliphatic polyether in resin (A) comprises polytetramethylene ether glycol.

8. The multilayer insulated wire according to claim 1, wherein said aromatic polyether in resin (A) comprises polytetramethylene ether terephthalate.

9. The multilayer insulated wire according to claim 1, wherein said aliphatic polyester in resin (A) comprises polylactone.

10. The multilayer insulated wire according to claim 1, wherein said thermoplastic polyester elastomer resin comprises a polyethylene terephthalate-series elastomer resin.

11. The multilayer insulated wire according to claim 1, wherein said thermoplastic polyester elastomer resin comprises a polybutylene terephthalate-series elastomer resin.

12. The multilayer insulated wire according to claim 1, wherein said thermoplastic polyester elastomer resin comprises resin (B).

* * * * *